US008846138B2

(12) United States Patent
Zhou et al.

(10) Patent No.: US 8,846,138 B2
(45) Date of Patent: Sep. 30, 2014

(54) SURFACE TREATMENT OF PRINT MEDIA

(75) Inventors: Xiaoqi Zhou, San Diego, CA (US); Xulong Fu, San Diego, CA (US); Gracy Wingkono, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/576,646

(22) PCT Filed: Mar. 10, 2010

(86) PCT No.: PCT/US2010/026857

§ 371 (c)(1),
(2), (4) Date: Aug. 1, 2012

(87) PCT Pub. No.: WO2011/112190

PCT Pub. Date: Sep. 15, 2011

(65) Prior Publication Data

US 2012/0301641 A1 Nov. 29, 2012

(51) Int. Cl.

| | |
|---|---|
| ***B05D 1/02*** | (2006.01) |
| ***B05D 5/04*** | (2006.01) |
| ***B05D 5/06*** | (2006.01) |
| ***D21H 19/80*** | (2006.01) |
| ***B41M 5/52*** | (2006.01) |
| ***D21H 17/66*** | (2006.01) |
| ***D21H 21/00*** | (2006.01) |
| *B05B 5/00* | (2006.01) |
| *B41M 5/50* | (2006.01) |

(52) U.S. Cl.

CPC ..... *B41M 5/5218* (2013.01); *D21H 19/80* (2013.01); *D21H 17/66* (2013.01); *D21H 21/00* (2013.01)

USPC ..... 427/158; 427/427.1; 427/288; 428/32.21

(58) Field of Classification Search

None

See application file for complete search history.

(56) References Cited

U.S. PATENT DOCUMENTS

| | | | | |
|---|---|---|---|---|
| 4,835,212 | A * | 5/1989 | Degen et al. | 524/734 |
| 5,115,972 | A * | 5/1992 | Maier et al. | 239/8 |
| 5,254,450 | A * | 10/1993 | Lacz et al. | 430/538 |
| 2002/0176970 | A1 * | 11/2002 | Kobayashi et al. | 428/195 |
| 2003/0211618 | A1 * | 11/2003 | Patel | 436/38 |
| 2004/0066446 | A1 * | 4/2004 | Yamaguchi et al. | 347/105 |
| 2004/0255820 | A1 | 12/2004 | Chen et al. | |
| 2007/0166474 | A1 * | 7/2007 | Nakano et al. | 427/407.1 |

FOREIGN PATENT DOCUMENTS

| | | | |
|---|---|---|---|
| EP | 1652684 | A1 | 5/2006 |
| WO | WO 9600816 | A1 * | 1/1996 |
| WO | 2004048114 | A1 | 6/2004 |

OTHER PUBLICATIONS

Raszillier, H. et al., (Spreading and sorption of a droplet on a porous substrate, Chemical Engineering Science, 59, 2004, 2071-2088).*

International Search Report (ISR) and Written Opinion of the International Searching Authority (ISA) mailed Jan. 28, 2011 from ISA/KR for counterpart PCT Application No. PCT/US2010/026857 (10 pages).

* cited by examiner

*Primary Examiner* — Michael Cleveland
*Assistant Examiner* — Francisco Tschen

(57) ABSTRACT

A method for surface treatment of a paper substrate and a paper product produced therefrom are disclosed herein. The surface treatment method includes applying a salt-containing solution to at least one surface of a paper substrate by aerosol spraying in a separate step, whereby the salt distribution through the thickness of the treated paper substrate is non-uniform with the highest concentration of salt being present in the outermost portion of the paper substrate. The salt-containing solution contains at least one water-soluble metal salt and is void of any optical brightening agent (OBA).

9 Claims, 7 Drawing Sheets

CROSS-CUT

DOME

SURFACE TREATMENT OF PRINT MEDIA

BACKGROUND

Commercial printing papers and multipurpose office papers used for inkjet printing and electrophotographic printing are typically subjected to surface treatment such as surface treatment such as surface sizing to affect the properties of the paper. Surface sizing is normally performed to increase the water resistance of the paper as well as its surface strength. By contrast, internal sizing (or wet-end sizing) is achieved by adding appropriate chemicals to the paper pulp during paper pulp preparation. The present disclosure generally relates to the surface treatment of print media and print media produced therefrom.

DETAILED DESCRIPTION

Figure 1:
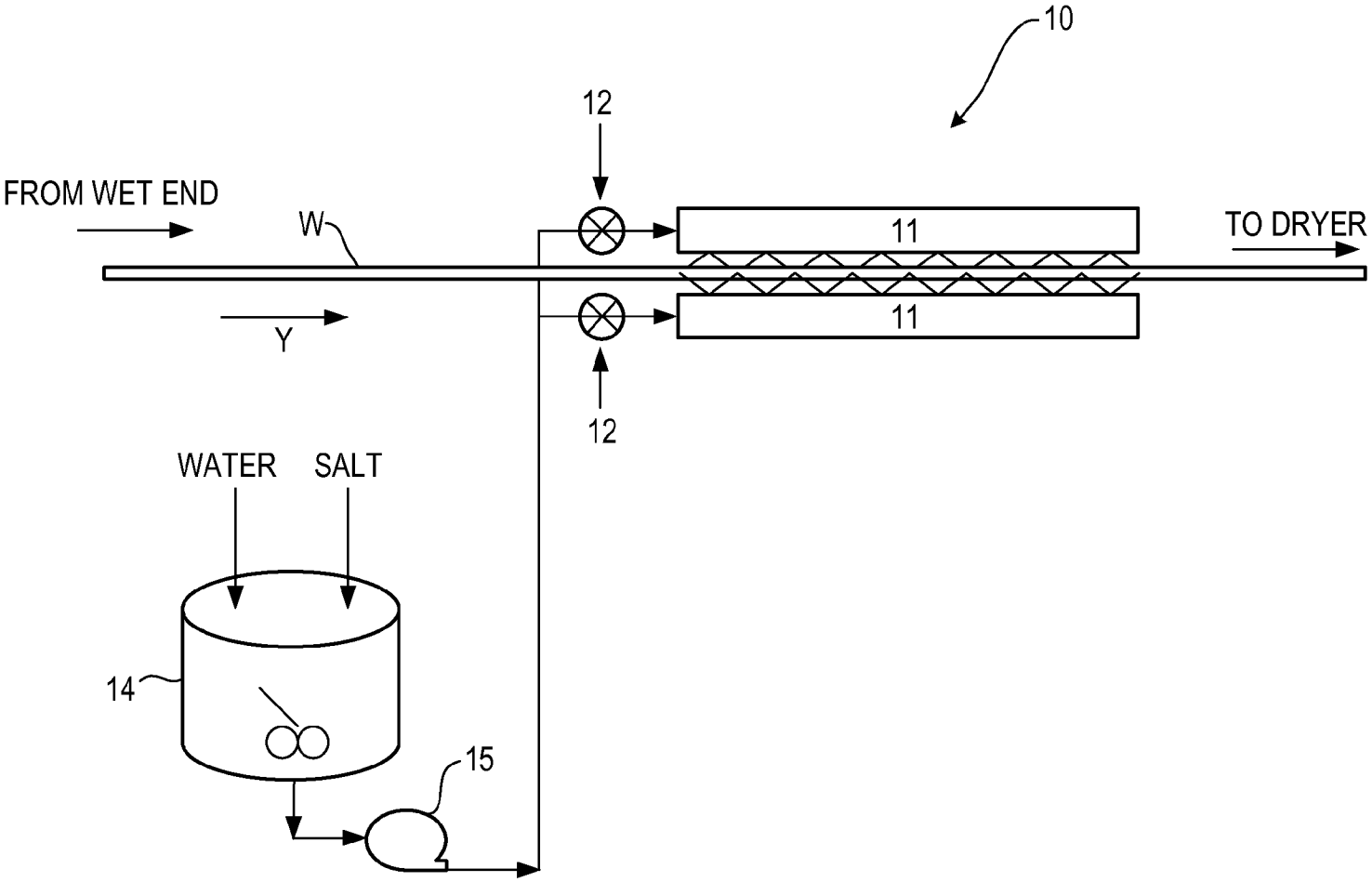
FIG. 1 shows an arrangement for aerosol spraying in a papermaking machine according to one embodiment of the present disclosure.

In recent years, the inkjet printing industry is moving more toward the use of pigmented ink. With prevalent use of pigmented inks, metal salts have been added to surface sizing solutions as the ink fixing agent. Surface sizing is conventionally carried out by means of a sizing device such as a size press located in a papermaking machine. The metal salts are normally mixed with the surface sizing agents, such as starch, and added to the paper web surface at the size press. The presence of metal salts in the surface-sized paper greatly improves printing quality such as black optical density (KOD), dry time and color saturation, especially when pigmented inks are used.

One issue associated with the use of metal salt is the impact to paper brightness and whiteness. Optical brightening agents (OBAs) or fluorescent whitening agents (FWAs) are often added to surface sizing solutions to improve the optical appearance of the paper like brightness or whiteness. OBAs or FWAs are compounds that absorb ultraviolet radiant energy at 300-360 nm of the electromagnetic spectrum, and re-emit energy in the visible range mainly in the blue wavelength region (typically 420-470 nm). The term "OBA", as used herein, is interchangeable with "FWA". Most Commercially available OBA are derivatives of sulphonated stilbene-based compounds such as Tinopal® from CIBA/BASF or Leucophor® from Clariant When metal salt is added to the surface sizing solution containing OBA, it quenches the effectiveness of the OBA. The heavy metal contaminants such as $Fe^{+++}$ and $Cu^{++}$ ions contained in low grade salts often make the quenching effect more predominant and drastically degrade the paper brightness and whiteness. This situation becomes even worse when the salt contained in the surface sizing solution is circulated and re-pumped into the surface sizing applicator because salts and OBA can react during an extended time period. To maintain the desired brightness and whiteness level of paper when salts are added, the OBA dosage has to be increased. The increase in OBA dosage not only results in significantly higher cost, but as OBA dosage increases to the saturation point or the "greening point", the OBA molecule will start to aggregate, and the wavelength of the re-emitted light becomes longer, the brightness or whiteness will no longer increase as OBA dosage increase, and the paper shade will get greener, and less blue.

The present disclosure discloses a novel method for paper surface treatment, which includes applying a metal salt-containing solution to a paper substrate by aerosol spraying. Aerosol spraying of the metal salt-containing solution may be conducted prior to or after surface sizing the same paper substrate with a binder-containing sizing composition, wherein surface sizing and aerosol spraying are carried out without any drying in between. This surface treatment results in an improved surface-treated paper with a special profile of metal salt distribution through the paper thickness whereby no less than 40% of the total salt applied by dry weight is in the top (outermost) portion of the paper, more specifically the portion between the outer surface to which metal salt was applied and 45 microns (μm) from the same outer surface.

The efficiency of salt usage is increased by having higher salt concentration near the outer surface of the paper substrate treated, not inside the bulk. This efficiency of salt usage results in a significant improvement in black optical density (KOD) per unit of salt used as well as a reduction in manufacturing cost. In addition, this novel surface treatment overcomes the issue of incompatibility between OBA and metal salt discussed above. In contrast, when the metal salt is part of the sizing solution that is applied to the paper surface via a conventional size press, the salt distribution in the paper tends to be homogeneous in the x, y and z directions (x direction being parallel to the width of the paper, y direction being parallel to the length, z direction being orthogonal to the outer surfaces of the paper and through the thickness of the paper). As such, more salt is needed to produce the effect desired.

The term "paper substrate" is meant to encompass a substrate based on cellulosic fibers, or any combination of cellulosic fibers, synthetic fibers and inorganic fibers, as well mineral filler such as calcium carbonate. The paper substrate may take the form of a web, sheet, or paperboard structure, which structure may be of variable dimensions. "Paper" is meant to encompass printing paper (e.g., inkjet printing paper, etc.), writing paper, drawing paper, and the like, as well as board materials such as cardboard, poster board, Bristol board, and the like.

The metal salt-containing solution is an aqueous solution containing at least one water-soluble metal salt. Suitable metal salts include but not limited to salts of monovalent and multivalent metals selected from the group consisting of Group I metals, Group II metals, Group III metals, transitional metals, and combinations thereof. These metal salts may further include an anion selected from the group consisting of chloride, iodide, bromide, nitrate, sulfate, sulfite, phosphate, chlorate, acetate, formate and combinations thereof. Specific examples thereof include barium chloride, calcium chloride, calcium acetate, calcium nitrate, calcium formate, magnesium chloride, manganese sulfate, magnesium nitrate, magnesium acetate, magnesium formate, zinc chloride, zinc sulfate, zinc nitrate, zinc formate, tin chloride, tin nitrate, manganese chloride, manganese sulfate, manganese nitrate, manganese formate, aluminum sulfate, aluminum nitrate, aluminum chloride, aluminum acetate and the like. These metal salts may be used alone or in combination of two or more. The metal salt concentration in the salt solution can be any concentration as long as it does not excess the critical saturated concentration. In a preferred embodiment, the metal salt concentration in the salt solution is from 0.1% to 30% by weight based on the total weight of the solution, and more preferably from 2% to 10% by weight. The amount of metal salt applied to the paper substrate via aerosol spraying ranges from 1.0 kilogram per ton (Kg/T) of paper to 10 kilograms per ton (Kg/T) of paper. As used in the present disclosure, the term "salt solution" refers to the metal salt-containing solution described herein.

The solvent used for the salt solution is water, but a mixture of water and one or more water-miscible solvents such as polyethylene glycol or alcohols may also be used for specific purposes such as moisture control. In addition to the metal salt discussed above, a small amount (up to 10% by weight) of optional additives such as emulsifiers, surfactants, humidifiers, crosslink agent, lubricants, color dyes and biocides may be added to the salt solution as long as the rheological properties meet the requirement of aerosol spraying. However, the salt solution is void of any OBA.

Aerosol spraying involves atomizing the salt solution into an aerosol mist of liquid particles and then dispensing this aerosol onto the paper surface by means of jetting nozzles. Aerosol is a gaseous suspension of fine solid or liquid particles. The nozzles along with controlling units, such as flow meters and pressure controllers, are configured and arranged so as to spray low viscosity liquids (i.e., below 1000 cps) in a uniform spray pattern on the paper surface. The nozzles are arranged in certain patterns, distance from the paper substrate, and angle with respect to paper substrate to ensure treatment uniformity. In addition to nozzle architecture, optimization of the flow rate and pressure are also critical to control the penetration of the sprayed liquid into the paper substrate.

The spraying assembly for aerosol spraying may be positioned at an open space between the wet end of the papermaking machine and the first drying means. FIG. 1 shows an arrangement for aerosol spraying in a conventional papermaking machine according to one embodiment. The spraying assembly 10 includes nozzle assemblies 11 arranged on opposite sides of the paper web W and pre-atomization units 12. The nozzle assemblies 11 are provided with a plurality of nozzles arranged to face both surfaces the paper web W and across the entire width of the paper web W. The salt solution is applied to the surface of paper web W by nozzles in which the solution is atomized into small droplets by air pressure prior to being deposited onto the moving paper web. The aerosol sprays can be controlled by adjusting the distance between the nozzles and the paper web, the aerosol-spray velocity and the mass rate of spraying. The pre-atomization unit 12 includes flow meters and pressure gauges. A supply tank 14 with stirrer and pump 15 are provided to supply the salt solution to the nozzle assemblies 11.

Figure 2A:
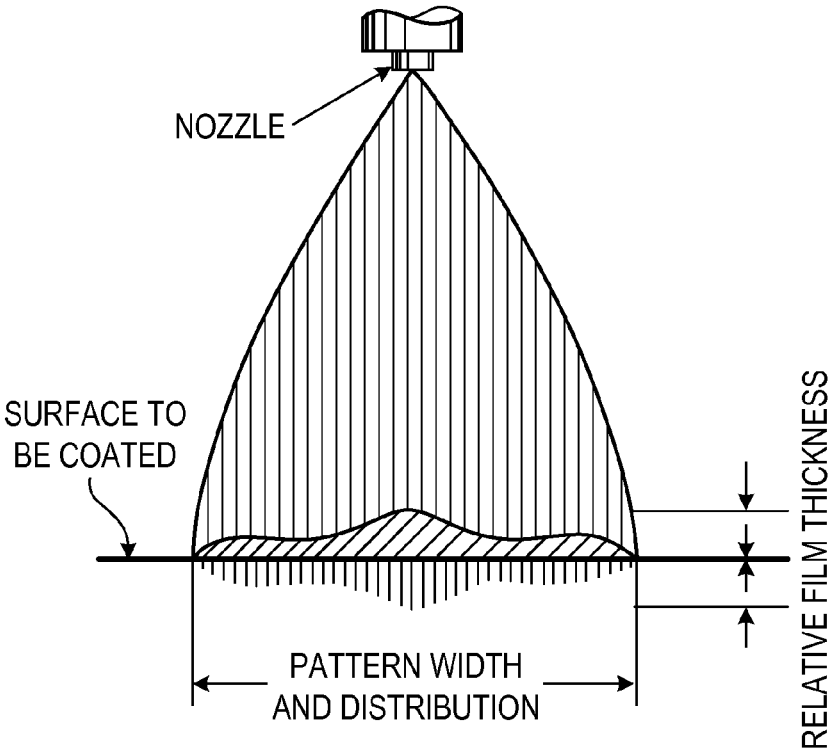
FIGS. 2A-2C show exemplary nozzle configurations for generating fan-shaped sprays.
Figure 2B:
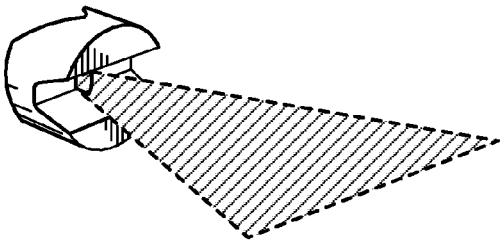
Figure 2C:
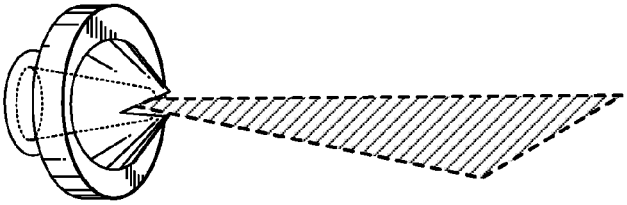

In a preferred embodiment, the nozzle assemblies 11 include nozzles designed to emit fan-shaped sprays. FIGS. 2A-2C show exemplary nozzle configurations for generating fan-shaped sprays (available from Nordson Corp.). The orifice size of the nozzle is chosen based on the volume of the salt-containing solution to be dispensed. The angle of the fan is chosen to provide uniform distribution of the salt solution based on the centerlines and the distance of the nozzle assembly to the spraying surface.

Referring again to FIG. 1, the salt solution may be sprayed to one side of the paper web W during each pass, but more preferably, both sides of the paper web are sprayed simultaneously. After passing through the spraying assembly 10, the paper web W is subsequently dried by a conventional dryer such as infrared dryer or hot air dryer, or combination of both.

As an example, the spraying parameters for the arrangement of FIG. 1 are disclosed in Table 1.

TABLE 1

| | |
|---|---|
| Nozzle type | .30/16 - Flat, cross-cut |
| Flow rate | 1400-5500 cc/min |
| Pressure | 400-850 psi |
| Paper web Speed | 800-3500 feet per minute (fpm) |

Under high web speed, the aerosol can only penetrate into the outer portion of the paper web, and a large surface area of the paper web is covered per unit volume of salt solution used. Those two effects combined create a well-controlled salt distribution in the z-direction through the paper thickness, which salt distribution results in a desirable paper structure wherein the salt acting as an ink fixative is mostly at the outermost portion of the paper but not inside the bulk, and consequently, the total salt concentration required in the paper to achieve an optimum image quality is relatively low. This novel method significantly reduces the salt usage but does not adversely alter certain paper properties such as the paper electrical property. In comparison, the conventional size press, such as that used in pond sizing or film sizing, is a "stationary" sizing device, whereby the sizing solution containing salt can be strongly absorbed by the hydrophilic paper web and penetrate deeper into the z-direction of the paper thickness. In order to obtain the comparable image quality, more salt is required with stationary sizing device.

In one embodiment, the spraying assembly 10 shown in FIG. 1 is positioned downstream from a surface sizing station and upstream of the dryer according to the travel direction y of the paper web W. In such arrangement, the salt solution is sprayed onto a paper web that has been surface-sized. In an alternative embodiment, the spraying assembly 10 is positioned upstream of the surface sizing station. In this embodiment, the paper web is first sprayed with the salt solution, and then surface sized without drying in between.

In yet another embodiment, aerosol spraying of the salt solution is incorporated into the existing shower station of a conventional papermaking machine. Most conventional papermaking machines are equipped with shower stations for spraying water directly on the already formed paper web to control the moisture content of the paper web as well as to clean the machine parts. The shower station is typically arranged just upstream of an on-line calendaring unit. A supply tank with salt solution and the required pressure pump may be connected to such shower station. Under such arrangement, the web moisture content can be controlled at the same time as treatment with salt.

As discussed above, aerosol spraying of the salt solution may be conducted prior to or after surface sizing. Surface sizing includes applying a binder-containing sizing composition to a surface of the paper substrate. The binder-containing sizing composition contains a water-soluble binder such as natural starch, modified starch, soy protein, polyvinyl alcohol, carboxymethylcellulose, or a water-dispersible binder such as styrene butadiene, styrene acrylate and polyvinyl acetate latexes, or combinations thereof. In a preferred embodiment, OBA is added to the binder-containing sizing composition. In this way, OBA can be applied to the paper surface separately from the application of metal salt. As such, the opportunity for the metal salt to react with the OBA that is present in the surface sizing composition is significantly reduced, and furthermore, the resultant treated paper yields higher brightness and whiteness. Suitable OBA includes conventional sulphonated stilbene-based materials such as Tinopal® from CIBA/BASF or Leucophor® from Clariant.

The amount of binder in the binder-containing sizing composition may be in the range of 15-100 kg/T of paper substrate. The amount of OBA in the binder-containing sizing composition may be in the range of 0.5-12 kg/T of paper substrate. The amount of binder-containing sizing composition applied to the paper substrate may range from 0.5 to 2.0 grams per square meter (gsm) per side. The binder-containing sizing composition may be applied to the paper substrate using any conventional surface sizing mechanisms such as a film size press with application rolls, puddle or gate roll type size press.

EXAMPLES

The following Examples will serve to illustrate representative embodiments and should not be construed as limiting of the disclosure in any way. All % referred to herein are by weight unless otherwise indicated.

Example 1

Two paper webs were made according to two different surface treatments—method A and method B. In method A, a paper web A was subjected to surface sizing with a starch-based formulation followed by aerosol spraying with a metal salt solution, and then drying. In method B, a paper web B was surface treated with a sizing formulation containing metal salt and starch using a conventional size press and then dried. The two paper webs were made from the same cellulosic fiber furnish containing 60:40 ratio of hardwood fibers to softwood fibers and 12% by weight of calcium carbonate as filler, and have a basis weight of 64 gsm.

Method A

Paper A was surface sized by a metered size press using the following starch-based sizing formulation:

Cationic Starch: 52 kg/T of paper substrate

Fluorescent whitening agent (FWA): 4 kg/T of paper

Synthetic surface sizing agent: 4 kg/T of paper.

Subsequently, paper A was sprayed using a salt solution contains 95% by weight deionized (DI) water and 5% by weight calcium chloride. The conditions of aerosol spraying are listed in Table 2.

TABLE 2

| | |
|---|---|
| Nozzle type | .30/16 - Flat, cross-cut |
| Flowrate | 1500 cc/min |
| Pressure | 700 psi |
| Paper Line Speed | 800 fpm |
| Salt load | 4 kg of salt per Ton of paper |

Method B

Paper B was surface sized by a metered size press using the following starch-based sizing formulation:

Cationic Starch: 52 kg/T of paper substrate

Calcium Chloride: 7 kg/T of paper substrate

Fluorescent whitening agents (FWA): 4 kg/T of paper substrate

Synthetic surface sizing agent: 4 kg/T of paper

Figure 3:
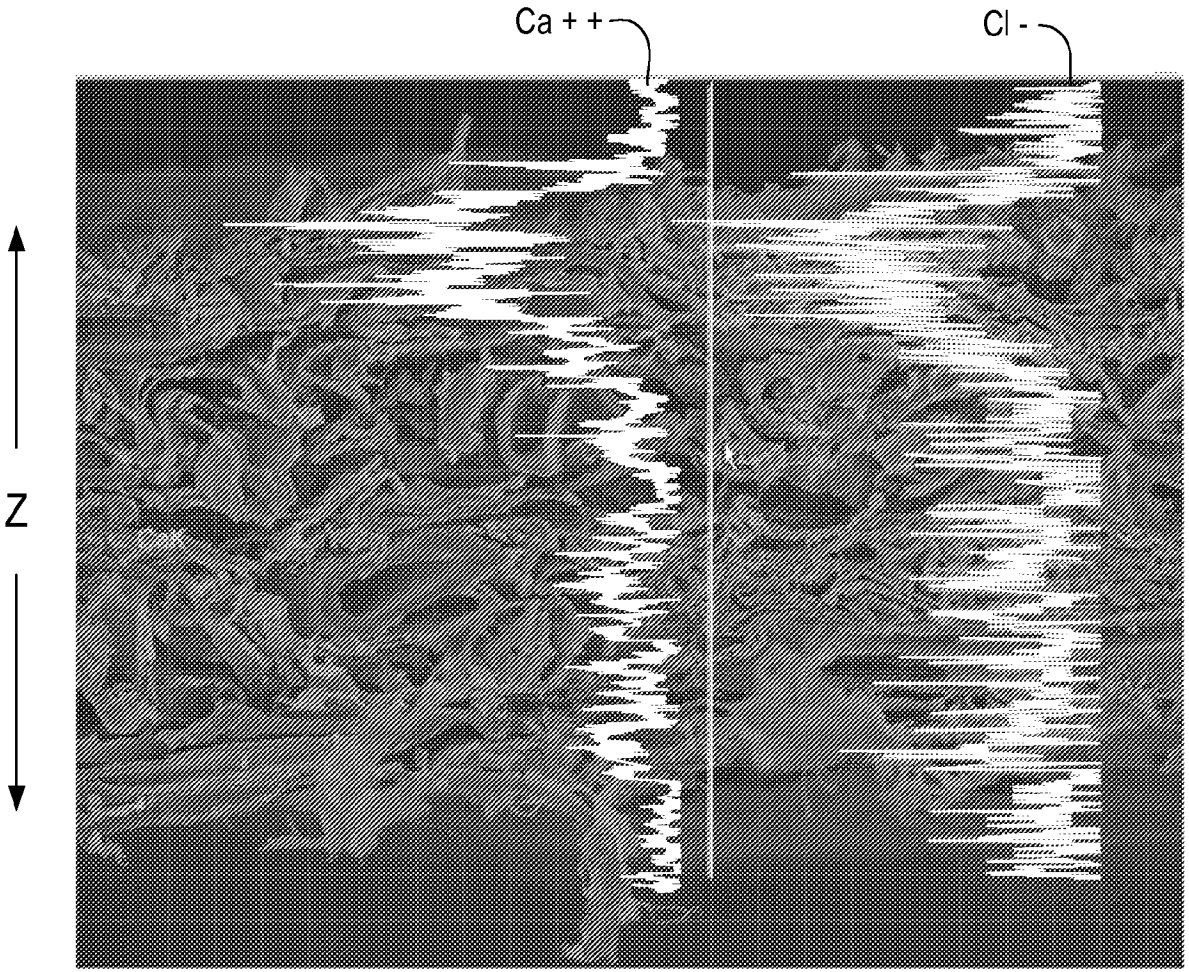
FIG. 3 is a SEM image showing a cross-sectional view of a paper treated according to the novel method of the present disclosure.
Figure 4:
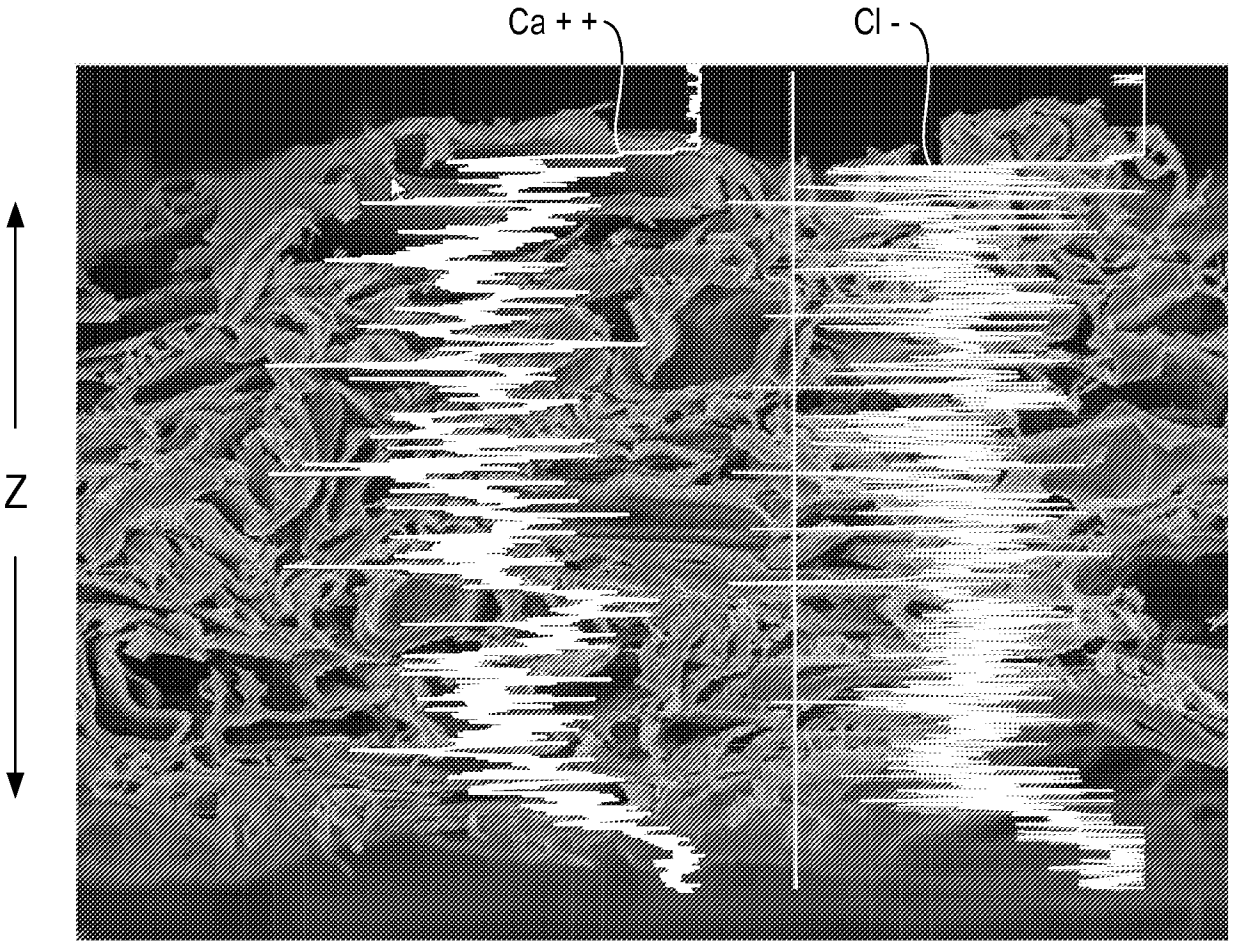
FIG. 4 is a SEM image showing a cross-sectional view of a paper treated according to a conventional method.

After drying, papers A and B were cross-sectioned using a cryo-microtome technique and the metal salt distribution through the thickness of the paper samples was analyzed using a Scanning Electron Microscope/Energy Dispersive X-Ray Spectroscopy (SEM/EDS) (Hitachi S4800), which can detect the elements present in a selected area of the SEM image. FIGS. 3 and 4 show the cross-sectional SEM images of papers A and B, respectively, and the EDS line scans for Ca++ and Cl− ions. As can be seen in FIG. 3, the EDS line scans show a non-uniform distribution of Ca++ and Cl− ions through the thickness of paper A (in z-direction) with a high concentration of Ca++ and Cl− in the topmost portion of the paper (as shown by an increase in x-ray response to the electron beam passing over the paper cross-section). In contrast, the line scans in FIG. 4 show a relatively uniform distribution of Ca++ and Cl− ions through the thickness of paper B.

Figure 5:
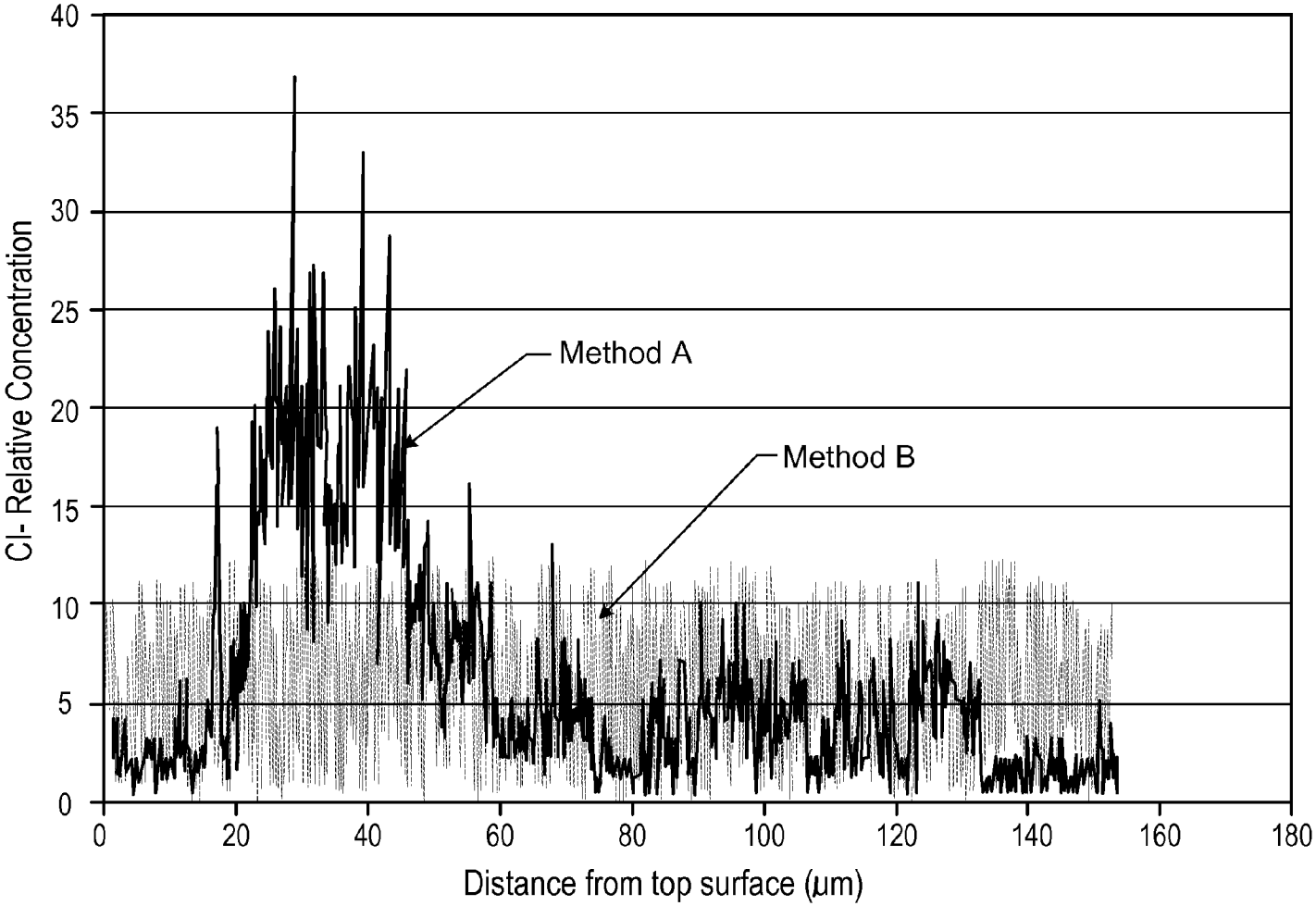
FIG. 5 graphically shows the distribution of metal salt in papers that have been treated differently.

FIG. 5 shows the line scans representing the distribution of Cl− ions in paper samples A and B relative to the distance (in μm) from the top surface of the paper sample. For the paper sample A, it can be determined that 69% of the total amount of salt applied is located between the top surface and 60 μm from the top surface.

Example 2

Figure 6:
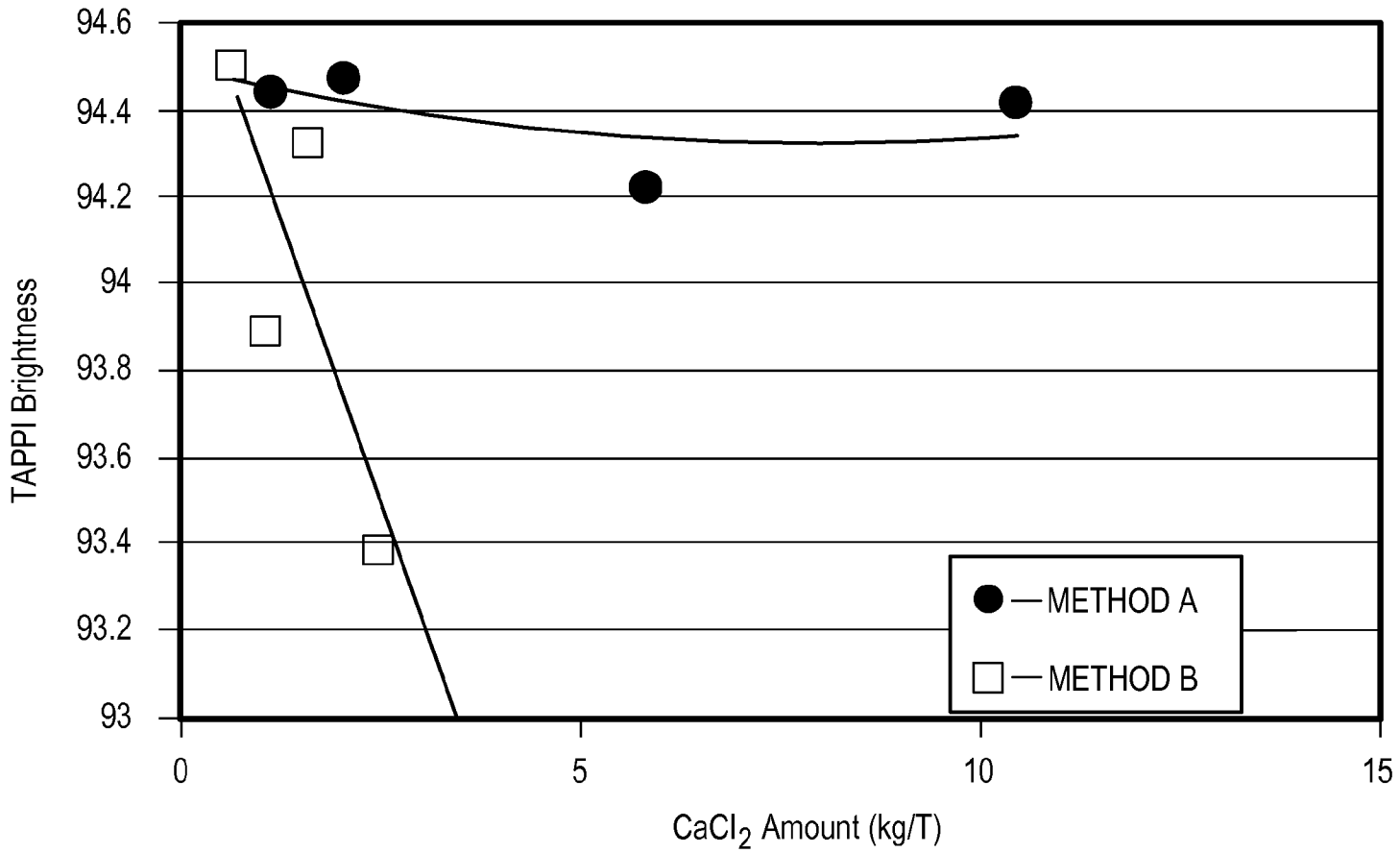
FIG. 6 graphically shows the effect of different metal salt amounts on TAPPI brightness under two different surface treatments.

A series of experiments were carried out to compare the two different surface treatments A and B discussed above. The conditions are the same as discussed above for methods A and B but the amount of metal salt was varied. FIG. 6 shows the effect of different metal salt amounts on TAPPI brightness under the two surface treatments. TAPPI brightness was measured using TAPPI 452 standard method. FIG. 6 shows that, under method A, the TAPPI brightness remains substantially unaffected by an increase in salt amount, whereas, under method B, the TAPPI brightness decreases linearly and drastically with an increase in salt amount.

Figure 7:
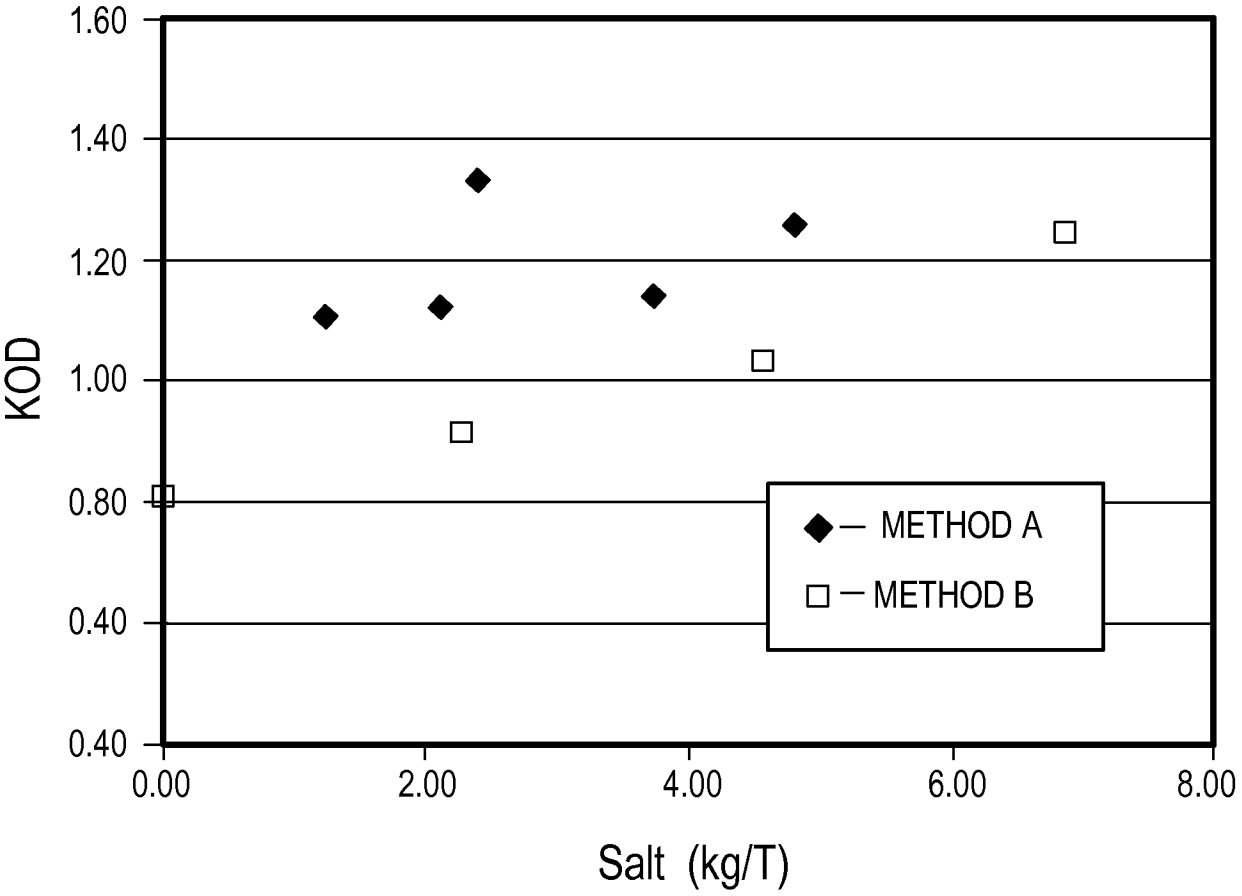
FIG. 7 graphically shows the effect of different metal salt amounts on black optical density (KOD) under two different surface treatments.

The papers produced by the two methods were then tested by applying 100 μL of black pigmented ink with Meyer Rod #8, and the black optical density (KOD) of the tested image was measured. The results are graphically shown in FIG. 7. FIG. 7 shows that higher KOD can be achieved with lesser amount of metal salt via method A as compared to method B.

While several embodiments and examples have been described in detail, it will be apparent to those skilled in the art that they may be modified. Therefore, the foregoing description is to be considered exemplary rather than limiting.

What is claimed is:

1. A method for surface treatment of a paper substrate comprising:

applying a salt-containing solution to at least one surface of the paper substrate by aerosol spraying; and separately applying a surface sizing composition to the at least one surface of the paper substrate using a size press either before or after applying the salt-containing solution and without drying in between the separate application steps, said salt-containing solution comprising at least one water-soluble metal salt having a metal cation in an aqueous solvent and being void of any optical brightening agent (OBA), the surface sizing composition comprising a water-soluble or water-dispersible binder, a surface sizing agent, and an OBA, wherein the salt-containing solution has a metal salt concentration of up to 30% by weight and a solids content of less than 30%, wherein aerosol spraying the salt-containing solution comprises using a flow rate ranging from 1400 cubic centimeters/min (cc/min) to 5500 cc/min, a pressure ranging from 400 pounds per square inch (psi) to 850 psi, and nozzles that produce a fan-shaped aerosol spray, and wherein the amount of metal salt applied is greater than 0 and up to 10 kilograms per ton of paper substrate, and the metal salt distribution through the thickness of the treated paper substrate achieved after applying the salt-containing solution is non-uniform with the highest concentration of metal salt being present in the outermost portion of the paper substrate.

2. The method of claim 1, wherein the metal salt concentration of the salt-containing solution ranges from 2% to 10% by weight.

3. The method of claim 1, wherein amount of metal salt applied to the paper substrate via aerosol spraying ranges from 1.0 kilogram to 10 kilograms per ton of paper substrate.

4. The method of claim 1, wherein a water-soluble metal salt of the salt-containing solution is a salt of monovalent or multivalent metal selected from the group consisting of Group I metals, Group II metals, Group III metals, transitional metals, and combinations thereof.

5. The method of claim 4, wherein said water-soluble metal salt further has an anion selected from the group consisting of chloride, iodide, bromide, nitrate, sulfate, sulfite, phosphate, chlorate, acetate, formate and combinations thereof.

6. The method of claim 1, wherein said binder is selected from the group consisting of natural starch, modified starch, soy protein, polyvinyl alcohol, carboxymethylcellulose, styrene butadiene, styrene acrylate, polyvinyl acetate latexes, and combinations thereof.

7. The method of claim 1, wherein said paper substrate comprises cellulosic fibers.

8. The method of claim 1, wherein said paper substrate is a moving paper web and the surface treatment is carried out in a papermaking machine comprising the size press and a drying device downstream from the size press in the moving direction of the paper web, wherein the moving paper web has a speed within a range of 800 feet per minute (fpm) to 3500 fpm.

9. The method of claim 8, wherein aerosol spraying of the salt-containing solution is conducted at a location between the size press and the drying device.

* * * * *